US012575658B2

(12) United States Patent
Charraud et al.

(10) Patent No.: US 12,575,658 B2
(45) Date of Patent: Mar. 17, 2026

(54) APPLICATOR WITH IN-LINE SENSOR

(71) Applicant: L'Oreal, Paris (FR)

(72) Inventors: Gregoire Charraud, Jersey City, NJ (US); Hyosik Dennis Min, Palisades Park, NJ (US); Rafael Feliciano, New Providence, NJ (US)

(73) Assignee: L'Oreal, Paris (FR)

( * ) Notice: Subject to any disclaimer, the term of this patent is extended or adjusted under 35 U.S.C. 154(b) by 267 days.

(21) Appl. No.: 18/345,095

(22) Filed: Jun. 30, 2023

(65) Prior Publication Data

US 2025/0000233 A1 Jan. 2, 2025

(51) Int. Cl.
*A45D 34/04* (2006.01)
*A45D 34/00* (2006.01)

(52) U.S. Cl.
CPC ..... *A45D 34/041* (2013.01); *A45D 2034/002* (2013.01); *A45D 2200/057* (2013.01); *A45D 2200/205* (2013.01)

(58) Field of Classification Search
CPC ..... A45D 34/041; A45D 40/261; A45D 2200/205; A45D 2044/007
USPC ..... 132/333
See application file for complete search history.

(56) References Cited

U.S. PATENT DOCUMENTS 8,027,505 B2 * 9/2011 Edgar ..... B41J 3/44 347/1
8,968,221 B2 * 3/2015 Pryor ..... A61H 15/02 601/19
10,010,155 B2 * 7/2018 Ajiki ..... G06V 40/172
11,110,293 B2 * 9/2021 Deane ..... A61N 5/0616
11,540,612 B1 * 1/2023 Zheng ..... A45D 34/041
11,590,465 B2 * 2/2023 Brandon ..... G06Q 50/04
(Continued)

FOREIGN PATENT DOCUMENTS

FR 3133119 A1 9/2023
WO WO-2014091035 A1 * 6/2014 ..... A61N 5/0616
(Continued)

OTHER PUBLICATIONS

Preliminary Search Report and Written Opinion mailed Mar. 8, 2024, issued in corresponding French Application No. 2309709, filed Sep. 14, 2023, 7 pages.
(Continued)

*Primary Examiner* — Thomas C Barrett
*Assistant Examiner* — Holly T. To
(74) *Attorney, Agent, or Firm* — Christensen O'Connor Johnson Kindness PLLC

(57) ABSTRACT

A system for applying a formula, the system including an applicator. The applicator includes a body, one or more reservoirs inside the body and configured to hold one or more formulas, an applicator surface coupled to the body and configured to apply the one or more formulas, one or more condition sensors located on the applicator, the one or more sensors configured to detect a condition of a portion of skin, before one or more formulas is applied to the portion of skin, and a position sensor configured to map the skin as the applicator surface moves across the skin, and a base device, including a base device processor configured to receive the condition from the one or more sensors, and direct the applicator to apply one or more treatments onto the portion of skin based on the condition.

20 Claims, 7 Drawing Sheets

(56) References Cited

U.S. PATENT DOCUMENTS

| | | | | |
|---|---|---|---|---|
| 11,633,106 | B2 * | 4/2023 | Yildirim | B01J 19/123 600/476 |
| 2004/0147984 | A1 * | 7/2004 | Altshuler | A46B 13/023 607/88 |
| 2016/0022011 | A1 * | 1/2016 | Rabe | A61B 5/4848 132/320 |
| 2018/0168318 | A1 * | 6/2018 | Streeter | A45D 33/32 |
| 2019/0240110 | A1 * | 8/2019 | Sedic | A61H 23/0254 |
| 2019/0388707 | A1 * | 12/2019 | Shenfarber | A61F 7/007 |
| 2020/0093254 | A1 * | 3/2020 | Charraud | A45D 20/12 |
| 2020/0196733 | A1 * | 6/2020 | Meschkat | A45D 34/041 |
| 2020/0196937 | A1 * | 6/2020 | Gopalan | A45D 44/005 |
| 2020/0205547 | A1 * | 7/2020 | Cheng | A45D 40/261 |
| 2021/0402208 | A1 * | 12/2021 | Edgar | A61B 5/0064 |
| 2022/0203115 | A1 * | 6/2022 | Gandman | G16H 50/20 |
| 2022/0309269 | A1 * | 9/2022 | Kosecoff | G06V 10/20 |
| 2023/0346103 | A1 * | 11/2023 | Charraud | A61N 5/0616 |
| 2023/0347165 | A1 * | 11/2023 | Charraud | A61N 5/0616 |
| 2023/0381724 | A1 * | 11/2023 | Charraud | B01F 33/846 |
| 2024/0423346 | A1 * | 12/2024 | Barbarino | A45D 44/005 |
| 2025/0000232 | A1 * | 1/2025 | Feliciano | A45D 34/041 |
| 2025/0000236 | A1 * | 1/2025 | Barbarino | H04N 1/00129 |
| 2025/0001149 | A1 * | 1/2025 | Charraud | A61M 35/003 |
| 2025/0001150 | A1 * | 1/2025 | Charraud | A61M 35/003 |
| 2025/0001198 | A1 * | 1/2025 | Feliciano | A61N 5/0616 |
| 2025/0064197 | A1 * | 2/2025 | Shadduck | A45D 34/041 |

FOREIGN PATENT DOCUMENTS

| | | | | |
|---|---|---|---|---|
| WO | WO-2015159482 | A1 * | 10/2015 | F16L 11/04 |
| WO | WO-2015193303 | A1 * | 12/2015 | A45D 34/041 |
| WO | WO-2016146778 | A1 * | 9/2016 | A61K 8/4913 |
| WO | 2021243403 | A1 | 12/2021 | |
| WO | WO-2023056383 | A1 * | 4/2023 | A45D 24/28 |
| WO | WO-2025006644 | A1 * | 1/2025 | A61B 5/4839 |

OTHER PUBLICATIONS

International Search Report and Written Opinion mailed Sep. 5, 2024, issued in corresponding International Application No. PCT/US2024/035675, filed Jun. 26, 2024, 16 pages.

Preliminary Search Report and Written Opinion mailed Apr. 2, 2024, issued in corresponding French Application No. 230974, filed Sep. 14, 2023, 7 pages.

Foreo Sweden, "UFO 3 Deep facial hydration: Like an iron for your wrinkles," 2023, 20 pages, Retrieved from the Internet: URL: https://www.foreo.com/ufo-collection.

* cited by examiner

APPLICATOR WITH IN-LINE SENSOR

SUMMARY

In one aspect, disclosed herein is a system for applying a formula including an applicator. In some embodiments, the applicator includes a body, one or more reservoirs inside the body, where the one or more reservoirs are configured to hold one or more formulas, an applicator surface coupled to the body, where the applicator surface is configured to apply the one or more formulas, one or more condition sensors located on the applicator, the one or more sensors configured to detect a condition of a portion of skin, before one or more formulas is applied to the portion of skin, and a position sensor configured to map the skin as the applicator surface moves across the skin. In some embodiments, the base device includes a base device processor configured to receive the condition from the one or more sensors and direct the applicator to apply one or more treatments onto the portion of skin based on the condition.

In some embodiments, the base device processor is further configured to compare the condition with a baseline condition of the skin and adjust the one or more treatments based on a deviation between the condition and the baseline condition.

In some embodiments, the portion of skin is a first portion of skin of a plurality of portions of skin, and wherein the base device processor is further configured to detect a condition of each portion of skin of the plurality of portions of skin and adjust the one or more treatments for each portion of skin of the plurality of portions of skin independently.

In some embodiments the applicator further includes one or more light sources, wherein the one or more light sources are configured to apply one or more light treatments. In some embodiments, the one or more sensors are arranged in a ring on the applicator. In some embodiments, the one or more light sources and the one or more sensors are alternately arranged in the ring. In some embodiments, an intensity, a frequency, a wavelength, or a combination thereof of the one or more light treatments is determined based on the condition of the skin. In some embodiments, the one or more treatments comprise application of the one or more formulations, the one or more light treatments, or a combination thereof.

In some embodiments, the applicator further includes one or more radiating elements, wherein the one or more radiating elements are configured to emit one or more radiation treatments, each having a frequency, an amplitude, and a power. In some embodiments, the treatment comprises application of the one or more formulations, the one or more radiation treatments, or a combination thereof. In some embodiments, the frequency, the amplitude, the power, or a combination thereof of the one or more radiation treatments is determined based on the condition of the skin.

In some embodiments, a flow rate, an amount, a temperature, a composition, or a combination thereof of the one or more formulas is determined based on the condition of the skin. In some embodiments, the one or more sensors are configured to measure an impedance, a capacitance, a deflection, a color, a texture, a hydration level, or a combination thereof of the skin. In some embodiments, the condition is hyperpigmentation, acne, dark spots, fine lines, wrinkles, sun damage, dryness, lack of hydration, oiliness, or a combination thereof.

In some embodiments, the applicator surface comprises one or more nozzles, wherein the one or more nozzles are in fluid communication with the one or more reservoirs. In some embodiments, each nozzle of the one or more nozzles is configured to dispense a different formula of the one or more formulas. In some embodiments, the amount of each formula of the one or more formulas dispensed is determined based on the condition. In some embodiments, the applicator surface is a roller ball, where the roller ball is in fluid communication with the one or more reservoirs and the roller ball is configured to apply the one or more formulas as the roller ball rolls.

In some embodiments, the system further comprises a communication device, communicatively coupled to the base device. In some embodiments, the communication device is configured to visualize the skin, highlight one or more portions of the skin, wherein the one or more portions of the skin are areas where a user has not yet applied the one or more formulas, areas based on a user history, or a combination thereof, direct the user to move the applicator over the one or more portions, and store the user history, wherein the user history is each time the user applies the one or more formulas with the applicator.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Described herein is a system for detecting a condition with an in-line sensor and adjusting one or more treatments based on the condition detected. In some embodiments, the one or more treatments include applying one or more formulas, light treatment, radiation treatment, or a combination thereof, as described herein. In some embodiments, the in-line sensor (or sensor module) is configured to detect a condition in 360 degrees from a central applicator surface and detect the condition directly before applying the treatment to an identified area of the skin. In some embodiments, a connected communication device can allow a user to select one or more formulas comprised of one or more formula ingredients, select a particular treatment, or identify one or more areas of concern. In some embodiments, the sensor module is one or more condition sensors, configured to detect one or more conditions as the applicator moves across the surface.

In some embodiments, the one or more formulas may be a moisturizer, a concealer, a wrinkle or fine line treatment, a toner, an acne treatment, a sunscreen, a foundation, or the like. In some embodiments, the base device includes one or more cartridges containing one or more formula ingredients including but not limited to aloe, vitamin C, coconut milk, or shea butter. When a user selects a desired formula with an application on the communication device, one or more formula ingredients can be dispensed into the applicator to create a personalized formula. As described herein, a formula may include one or more formula ingredients or a single formula ingredient.

In some embodiments, the user can apply the formula to their skin while light treatment, such as near-infrared (NIR) light treatment, red light treatment, blue light treatment, yellow light treatment, or a combination thereof is applied to further treat the condition. In some embodiments, the user can apply the formula to their skin while radiation treatment is applied, such as X-rays, gamma rays, electrons, proton, neutrons, or a combination thereof to further treat the condition. In some embodiments, the radiation treatment is ultraviolet (UV) light. In some embodiments, the radiation treatment is configured to treat eczema, psoriasis, jaundice, fungal mycoides, and the like.

Figure 1C:
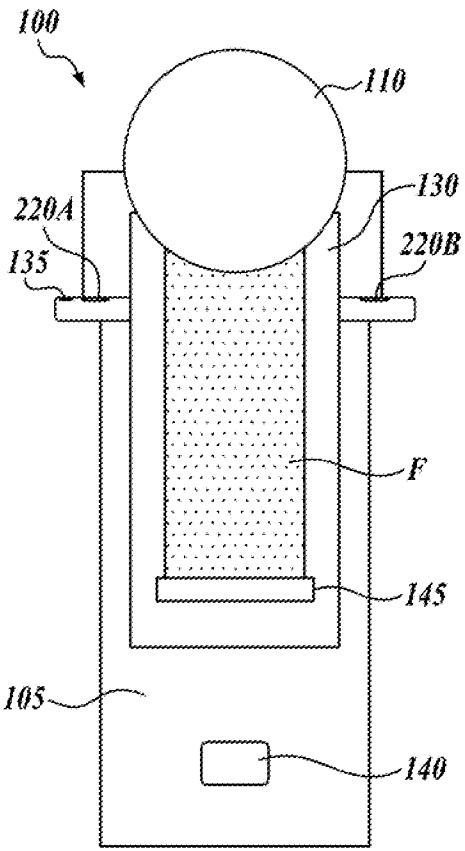
FIG. 1C is another example cross-section of the applicator of FIG. 1A, in accordance with the present technology.
Figure 1B:
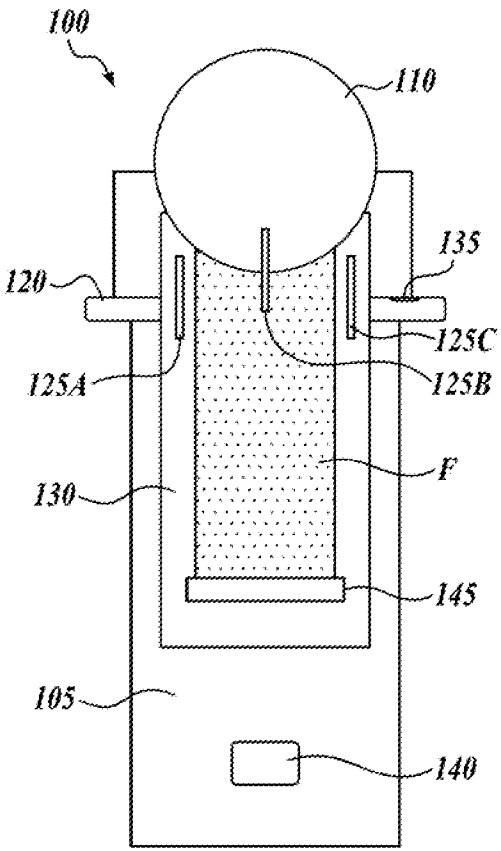
FIG. 1B is an example cross-section of the applicator of FIG. 1A, in accordance with the present technology.
Figure 1A:
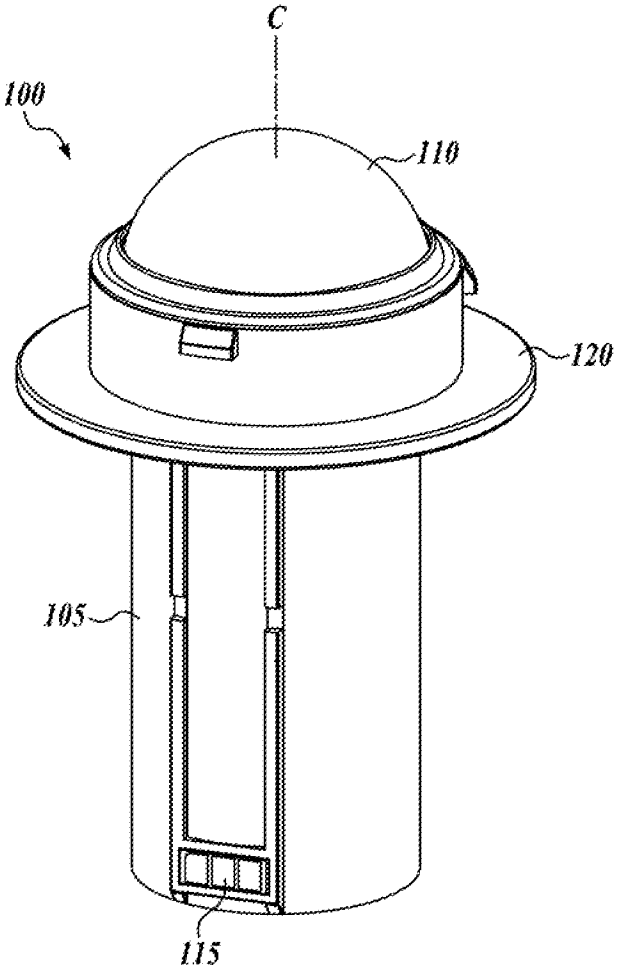
FIG. 1A is an example applicator, in accordance with the present technology.

FIG. 1A is an example applicator, in accordance with the present technology. Applicator 100 may include a body 105, an applicator surface 110, a tag 115, and a platform 120. Also illustrated is a cross-section line C, along which FIGS. 1B and 1C are taken.

In some embodiments, the applicator 100 includes a body 105. In some embodiments, the body 105 is configured to contain additional components and/or circuitry, as shown in FIGS. 1B and 1C.

The applicator surface 110 may take any number of forms, including a roller ball configured to distribute and apply a formula located a reservoir inside the applicator 100 (as shown in FIGS. 1B-1C). In some embodiments, the roller ball 110 is plastic, but in other embodiments, the roller ball 110 may be glass or metal. In some embodiments, the roller ball is transparent.

Figure 4:
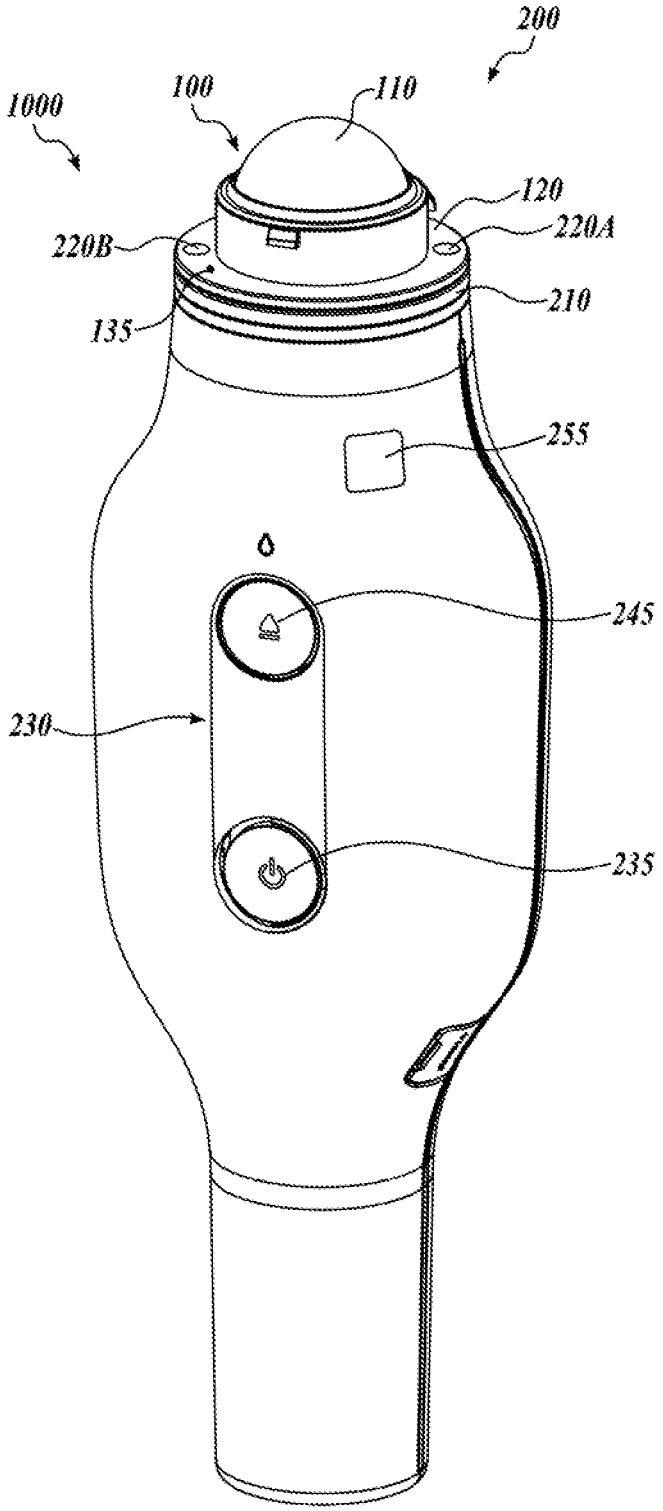
FIG. 4 is an example system including an applicator and a base device, in accordance with the present technology.

In some embodiments, the applicator 100 further includes a tag 115. In some embodiments, the tag 115 is a quick response (QR) code, radiofrequency identification (RFID) tag, barcode, or the like. In some embodiments, the tag 115 communicates an identity of the applicator 100 or the one or more formulations inside the applicator 100 to a base device, such as shown in FIG. 4. In some embodiments, the tag 115 may be used to identify any number of things about the one or more formulas or applicator 100, including the amount of formula inside the applicator 100, the expiration date of the formula 140 inside the applicator 100, or when to replace the applicator 100.

In some embodiments, the applicator 100 also includes an platform 120 configured to secure the applicator 100 into a base device, such as the base device 200 in FIG. 4. While the platform 120 is illustrated as a disk configured to couple to a base device, the platform 120 may take any form capable of securing the applicator to a base device including a threaded attachment, a magnet, or an attachment configured to snap into the base device. In some embodiments, the platform 120 is clear so that the base device is visible through the attachment. In some embodiments, the platform 120 may include any number of additional components, such as shown in detail in FIGS. 3A-3B. In some embodiments, the applicator 100 may be configured to apply a specific type of treatment, such as light treatment or radiation treatment. In other embodiments, the applicator 100 may be configured to apply a combination of types of treatments, such as light treatment and radiation treatment. In some embodiments, the light treatment is near-infrared (NIR) light treatment, red light treatment, blue light treatment, and/or yellow light treatment.

In operation, the applicator 100 may be placed inside a base device (as shown in FIG. 4) and secured to the base device with the platform 120. The roller ball 110 may be rolled over a surface, such as a user's skin, to apply a formula.

FIG. 1B-1C are example cross-sections of an applicator, in accordance with the present technology. The applicator 100 includes a body 105, an applicator surface 110, an platform 120, a reservoir 130 configured to hold a formula F, a piston 145, and an applicator processor 240.

In some embodiments, the reservoir 130 is located inside the body 105, and is configured to hold a formula F. In some embodiments, the formula F is a skin care formula. In some embodiments, the skin care formula is a moisturizer, a toner, an acne treatment, a wrinkle treatment, fine line treatment, or a cosmetic. As the applicator surface, illustrated here as a roller ball 110 moves or rolls, formula F from the reservoir 130 is applied to a surface. In some embodiments, the applicator 100 includes any number of formula reservoirs.

In some embodiments, the applicator 100 further includes a piston 150 configured to push the formula 140 towards the roller ball 110 as the formula is applied. In some embodiments, the piston 150 is directed by circuitry on a base device or on the applicator 100 itself to push the formula 140 towards the applicator surface.

In some embodiments, the applicator 100 includes an applicator processor 140. In some embodiments, the applicator processor 140 is configured to direct the piston to push the formula F towards the applicator surface 110. In some embodiments, the applicator processor 140 may further be configured to detect a condition of the skin with one or more sensors as described herein, and/or to direct the applicator 100 to apply one or more treatments, as described herein.

FIG. 1B is an example cross-section of the applicator 100 of FIG. 1A, in accordance with the present technology. In some embodiments, FIG. 1B is a cross-section along cross-section line C in FIG. 1A. In some embodiments, the applicator 100 is configured to administer radiation treatment. In some embodiments, the applicator 100 further includes a sensor module 135 and one or more radiating elements 125A, 125B, 125C. While three radiating elements 125A, 125B, 125C are illustrated in FIG. 1B, it should be understood that any number of radiating elements 125A, 125B, 125C may be incorporated into applicator 100. In some embodiments, the radiating elements 125A, 125B, 125C include antennas. In some embodiments, the radiating elements 125A, 125B, 125C are located behind and around the applicator surface 110 as shown in FIG. 1B. In some embodiments, the radiating elements 125A, 125B, 125C are configured to produce one or more beams of radiation energy and direct the radiation energy to the skin.

In some embodiments, the sensor module 135 is configured to detect a condition of a portion of the skin and determine an intensity, power, amplitude, or frequency of the radiation energy. In some embodiments, the sensor module 135 may be one or more sensors configured to measure a condition data of the skin and transmit the condition data to the applicator processor 140. The applicator processor 140 may then determine whether to administer one or more treatments, including applying one or more formulas F from the formula reservoir 130, the radiation treatment, or combinations thereof.

FIG. 1C is another example cross-section of the applicator 100 of FIG. 1A, in accordance with the present technology. In some embodiments, FIG. 1C is a cross-section along cross section line C in FIG. 1A In some embodiments, the applicator 100 is configured to apply one or more light treatments. In some embodiments, the one or more light treatments are applied with one or more light sources 220A, 220B. While two light sources 220A, 220B are illustrated, it should be understood that any number of light sources may be incorporated into the applicator 100. In some embodiments, the applicator 100 further includes a sensor module 135. In some embodiments, the sensor module 135 is one or more sensors configured to measure a condition data of a portion of the skin. The condition data may be sent to the applicator processor 240, which may direct the applicator 100 to apply one or more treatments, such as by dispensing the formula F or by applying light treatment. In some embodiments, light sources 220A, 220B are configured to administer light treatment, including, but not limited to blue light, yellow light, near infrared light, or a combination thereof.

One skilled in the art should understand that in some embodiments, the applicator 100 may be configured to administer both radiation treatment and light treatment, concurrently or independently. FIGS. 1B-1C should not be interpreted as mutually exclusive, and in some embodiments, applicator 100 may include all of the components illustrated in both FIGS. 1B and 1C.

Figure 2C:
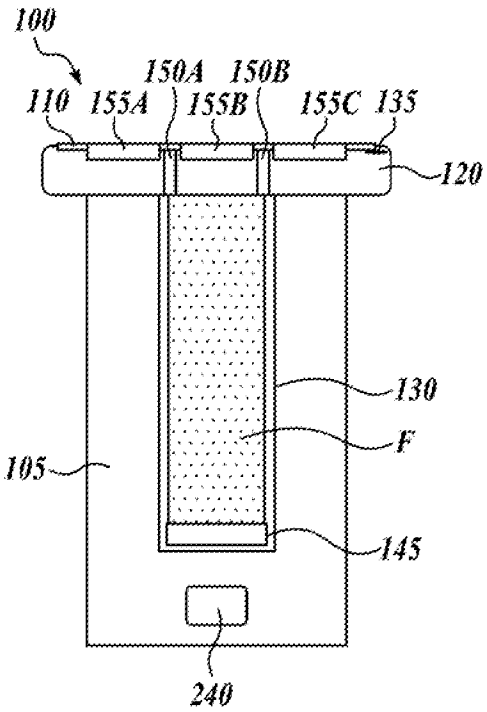
FIG. 2C is another example cross-section of the applicator of FIG. 2A, in accordance with the present technology.
Figure 2B:
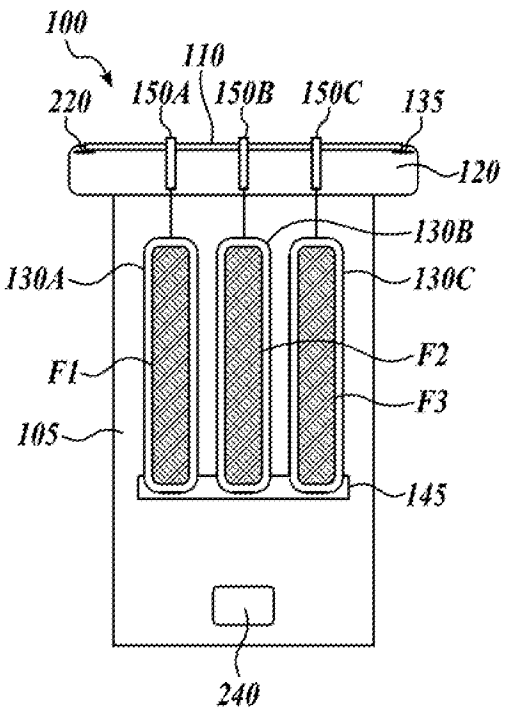
FIG. 2B is an example cross-section of the applicator of FIG. 2A, in accordance with the present technology.
Figure 2A:
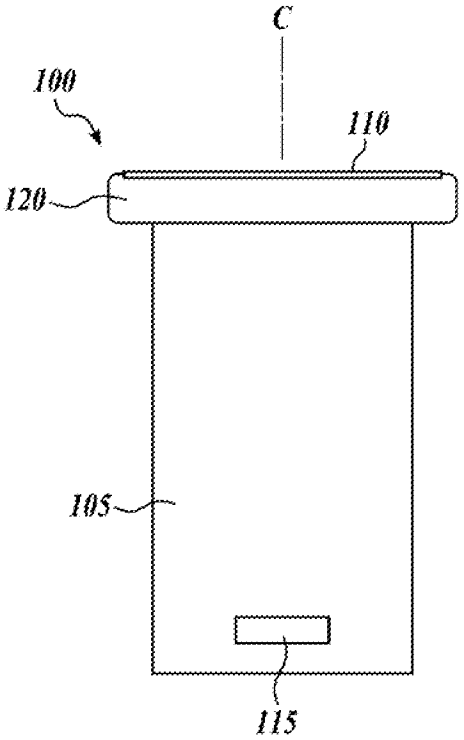
FIG. 2A is another example applicator, in accordance with the present technology.

FIG. 2A is another example applicator 100, in accordance with the present technology. In some embodiments, the applicator includes a body 105, an platform 120, an applicator surface 110, and a tag 115.

In some embodiments, the applicator includes a flat applicator surface 110. In operation, the applicator surface 110 may be moved across the skin. In some embodiments, the applicator surface 110 is the same size and length of the platform 120. In some embodiments, the applicator surface 110 is integrated into the platform 120. In some embodiments, the applicator surface includes one or more nozzles, as shown in FIGS. 2B-2C.

FIG. 2B-2C are example cross-sections of an applicator, in accordance with the present technology. The applicator 100 may include a body 105, an applicator surface 110, a platform 120, a sensor module 135 one or more formula reservoirs 130 configured to hold a formula F, a piston 145, and an applicator processor 240.

In some embodiments, the one or more reservoirs 130 is located inside the body 105, and is configured to hold one or more formulas F. In some embodiments, the one or more formulas F are a skin care formula. In some embodiments, the skin care formula is a moisturizer, a toner, an acne treatment, a wrinkle treatment, fine line treatment, or a cosmetic. As the applicator surface, illustrated here as a flat applicator surface 110 moves across the surface formula F from the reservoir 130 is applied to the surface through one or more nozzles 150.

In some embodiments, the applicator 100 further includes a piston 145 configured to push the formula F towards the one or more nozzles 150A, 150B, 150C as the formula F is applied. In some embodiments, the piston 145 is directed by circuitry on a base device or on the applicator itself to push the formula F towards the applicator surface 110.

In some embodiments, the applicator 100 includes an applicator processor 240. In some embodiments, the applicator processor 240 is configured to direct the piston to push the formula 240 towards the applicator surface 110. In some embodiments, the applicator processor 240 may further be configured to detect a condition of the skin with one or more sensors as described herein, and/or to direct the applicator 100 to apply one or more treatments, as described herein.

FIG. 2B is an example cross-section of the applicator 100 of FIG. 2A, in accordance with the present technology. In some embodiments, the applicator 100 includes a plurality of formula reservoirs 130A, 130B, 130C. In some embodiments, each formula reservoir 130 of the formula reservoirs 130A, 130B, 130C is configured to hold a distinct formula F of a plurality of formulas F1, F2, F3. In some embodiments, each formula reservoir 130 of the plurality of formula reservoirs 130A, 130B, 130C are fluidly coupled to a nozzle 150 of a plurality of nozzles 150A, 150B, 150C on the applicator surface 110. In such embodiments, each nozzle 150 is configured to dispense a different formula F. One skilled in the art should understand that in some embodiments, a reservoir 130 of the plurality of reservoirs 130A, 130B, 130C may be fluidly coupled to more than one nozzle 150. Further, in some embodiments, each nozzle 150 may be connected to more than one reservoir of the plurality of reservoirs 130A, 130B, 130C.

Figure 3B:
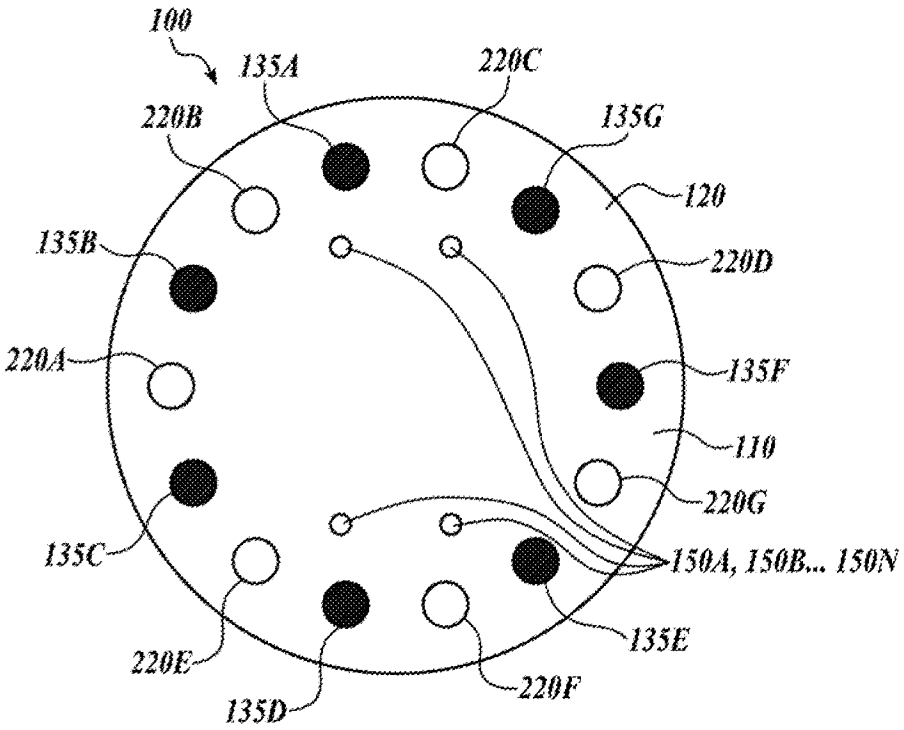
FIGS. 3A-3B are top views of example applicators, in accordance with the present technology.
Figure 3A:
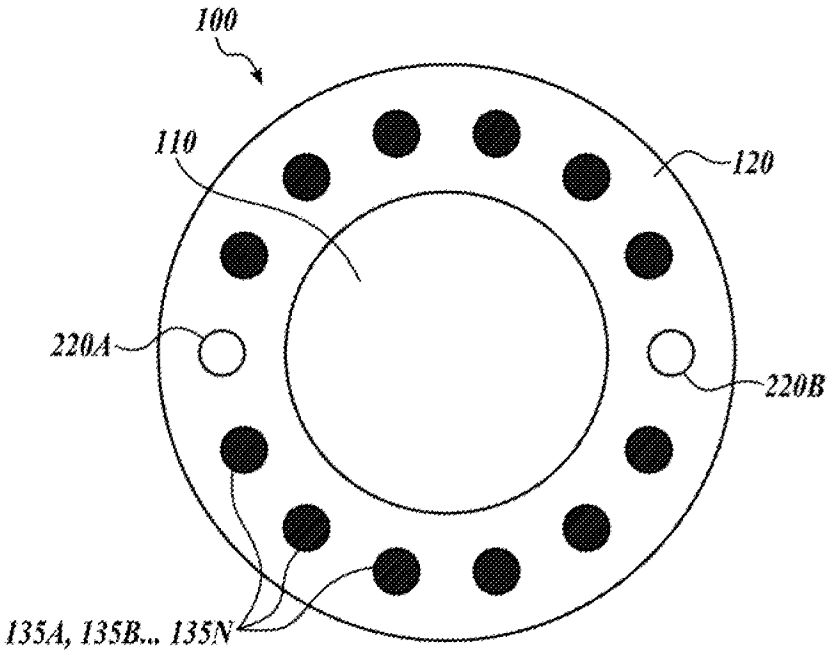

In some embodiments, the applicator 100 further includes a sensor module 135, configured to detect a condition of a portion of the skin, as described in detail in FIGS. 3A-3B. In some embodiments, the applicator 100 is configured to administer one or more light treatments. In some embodiments, the one or more light treatments are applied with one or more light sources 220. While a single light source 220 is illustrated, it should be understood that any number of light sources may be incorporated into the applicator 100. In some embodiments, the sensor module 135 is one or more sensors configured to detect a condition of a portion of the skin and configured to direct the applicator processor 240 to apply one or more treatments.

FIG. 2C is another example cross-section of the applicator 100 of FIG. 2A, in accordance with the present technology. In some embodiments, FIG. 2C is a cross-section along cross section line C in FIG. 2A. In some embodiments, the applicator 100 includes a reservoir 130 configured to hold a formula F, and one or more radiating elements 125A. 125B. 125C on an applicator surface 110 having one or more nozzles 150A, 150B.

In some embodiments, the applicator 100 is configured to administer radiation treatment. In some embodiments, the applicator 100 further includes a sensor module 135 and one or more radiating elements 125A, 125B, 125C. While three radiating elements 125A, 125B, 125C are illustrated in FIG. 1B, it should be understood that any number of radiating elements 125A, 125B, 125C. In some embodiments, the radiating elements 125A, 125B, 125C are antennas. In some embodiments, the radiating elements 125A, 125B, 125C are located on the applicator surface 110. In some embodiments, the radiating elements 125A, 125B, 125C are configured to produce one or more beams of radiation energy to the skin. In some embodiments, the radiation treatment comprises phototherapy. In some embodiments, the radiation treatment is ultraviolet (UV) treatment. In some embodiments, the UV treatment is used to treat eczema, psoriasis, jaundice, vitiligo, mycosis fungoides, and the like.

In some embodiments, the sensor module 135 is configured to measure condition data of at least a portion of the skin and transmit the condition data to the applicator processor 240. The applicator processor 240 may then determine an intensity, power, amplitude, or frequency of the radiation energy based on the condition data. In some embodiments, sensor module 135 (also referred to herein as an "in-line sensor") may be one or more sensors configured to detect a condition of the skin and determine whether to administer one or more treatments, including applying one or more formulas F from the formula reservoir 130, the radiation treatment, or combinations thereof.

One skilled in the art should understand that in some embodiments, the applicator 100 may be configured to administer both radiation treatment and light treatment, concurrently or independently. FIGS. 1B-1C should not be interpreted as mutually exclusive, and in some embodiments, applicator 100 may include some or all of the components illustrated in both FIGS. 1B and 1C.

FIGS. 3A-3B are top views of example applicators 100, in accordance with the present technology. In some embodiments, one or more sensor modules 135, the one or more light sources 220, or both are arranged on the applicator 100 in a ring. In some embodiments, any number of sensor modules 135 and light sources 220 may be located in the ring. In some embodiments, the applicator 100 includes two light sources 220A, 220B located on opposite sides of the ring, such as shown in FIG. 3A. In some embodiments, the applicator 100 includes a plurality of sensors 135A, 135B . . . 135N located in the ring. In this manner, the applicator 100 can detect one or more conditions on one or more portions of the skin, regardless of how a user moves (i.e., speed, direction, etc.) the applicator 100. In this manner, the sensors 135 can detect the one or more conditions in a full 360-degree field of view from the applicator surface 110.

In some embodiments, the light sources 220A, 220B, 220C, 220D, 220E, 220F, 220G can be alternated with the one or more sensor modules 135A, 135B, 135C, 135D, 135E, 135F, 135G as shown in FIG. 3B. In this manner, the applicator 100 may both detect a condition of one or more areas of the skin and administer light treatment or treatment in any direction as the applicator moves across the skin.

While FIG. 3A is illustrated as having a roller ball applicator surface 110 and FIG. 3B is illustrated as having an applicator surface 110 with a plurality of nozzles 150A, 150B, 150C, 150D, one skilled in the art would know that either applicator surface 110 could be incorporated with either arrangement of one or more sensor modules 135A, 135B, 135C, 135D, 135E, 135F, 135G and light sources 220A, 220B, 220C, 220D, 220E, 220F, 220G. Further, either applicator surface 110 could be incorporated with any arrangement of sensors 135 and light sources 220, not limited to those shown in FIGS. 3A-3B.

In some embodiments, the one or more sensor modules 135A, 135B, 135C, 135D, 135E, 135F, 135G are configured to measure an impedance, a capacitance, a deflection, a color, a texture, a hydration level, or a combination thereof of the skin. In some embodiments, each sensor of the one or more sensor modules 135A, 135B, 135C, 135D, 135E, 135F, 135G is configured to measure a distinct parameter (capacitance, impedance, deflection, a color, a texture, etc.). In some embodiments, each sensor of the one or more sensor modules 135A, 135B, 135C, 135D, 135E, 135F, 135G are configured to detect a combination of parameters. In some embodiments, the one or more sensor modules 135A, 135B, 135C, 135D, 135E, 135F, 135G include one or more duplicate sensors configured to measure a same parameter. In some embodiments, the condition is hyperpigmentation, acne, dark spots, fine lines, wrinkles, sun damage, dryness, lack of hydration, oiliness, or a combination thereof.

FIG. 4 is an example system 1000 including an applicator 100 and a base device 200, in accordance with the present technology. In some embodiments, the applicator 100 can be attached to a base device 200. In some embodiments, the base device includes one or more light sources 220A, 220B, and an actuator 230. In some embodiments, the one or more light sources 220A, 220B may be located on the base device 100, the applicator 100, or both. In some embodiments, either the base device 200 or the applicator 100 includes one or more sensor modules 135.

In some embodiments, the base device 200 includes an end 210. The end 210 may be configured to be visible through the platform 120 on the applicator 100. In some embodiments, the end 210 includes one or more light sources 220A, 220B configured to administer light treatment to a surface while the formula is being applied.

In some embodiments, the one or more light sources 220A, 220B on either the base device 200 or the applicator 100 are LEDs. In some embodiments, there are only two light sources 220A, 220B on the base device. In some embodiments, a first light source 220A is configured to administer light treatment in a first wavelength. In some embodiments, a second light source 220B is configured to administer light treatment in a second wavelength. In some embodiments, the light treatment in the first wavelength and the light treatment in the second wavelength are administered simultaneously. In some embodiments, the light treatment and applying the formula happen simultaneously.

In some embodiments, the base device 200 includes one or more actuators 230. While the actuators 230 are illustrated as buttons, in some embodiments, the actuators 230 may be switches, capacitive touch type buttons, dials, or the like. The one or more actuator 230 may be configured to begin the administration of light treatment, to apply the formula, or both. In some embodiments, the one or more actuators 230 include a power button 235 and an application button 245. In some embodiments, the power button 235 is configured to turn the base device on or off, while the application button 245 is configured to administer one or more treatments described herein, including light treatment, radiation treatment, or the application of one or more formulas. In some embodiments, the base device 200 further includes one or more sensor modules 135 configured to detect a condition of the portion of the skin. In some embodiments, the one or more sensor modules 135 are located on the applicator 100, the base device 200, or a combination thereof. In some embodiments, the base device 200 further includes a base device processor 255. In some embodiments, the base device processor 255 is configured to direct the applicator 100, the base device 200, or both to administer one or more treatments in response to a condition detected by the one or more sensor modules 135. In some embodiments, the base device 200 also includes a contactless chip reader (not pictured in FIG. 4) to read the tag 115 on the applicator 100.

In operation, a user may place an applicator 100 into the base device 200. When the actuator 230 is actuated (such as by pressing the application button 245), the formula is applied, the light treatment is administered, the radiation treatment is administered or some combination of treatments is applied, concurrently or simultaneously.

Figure 5:
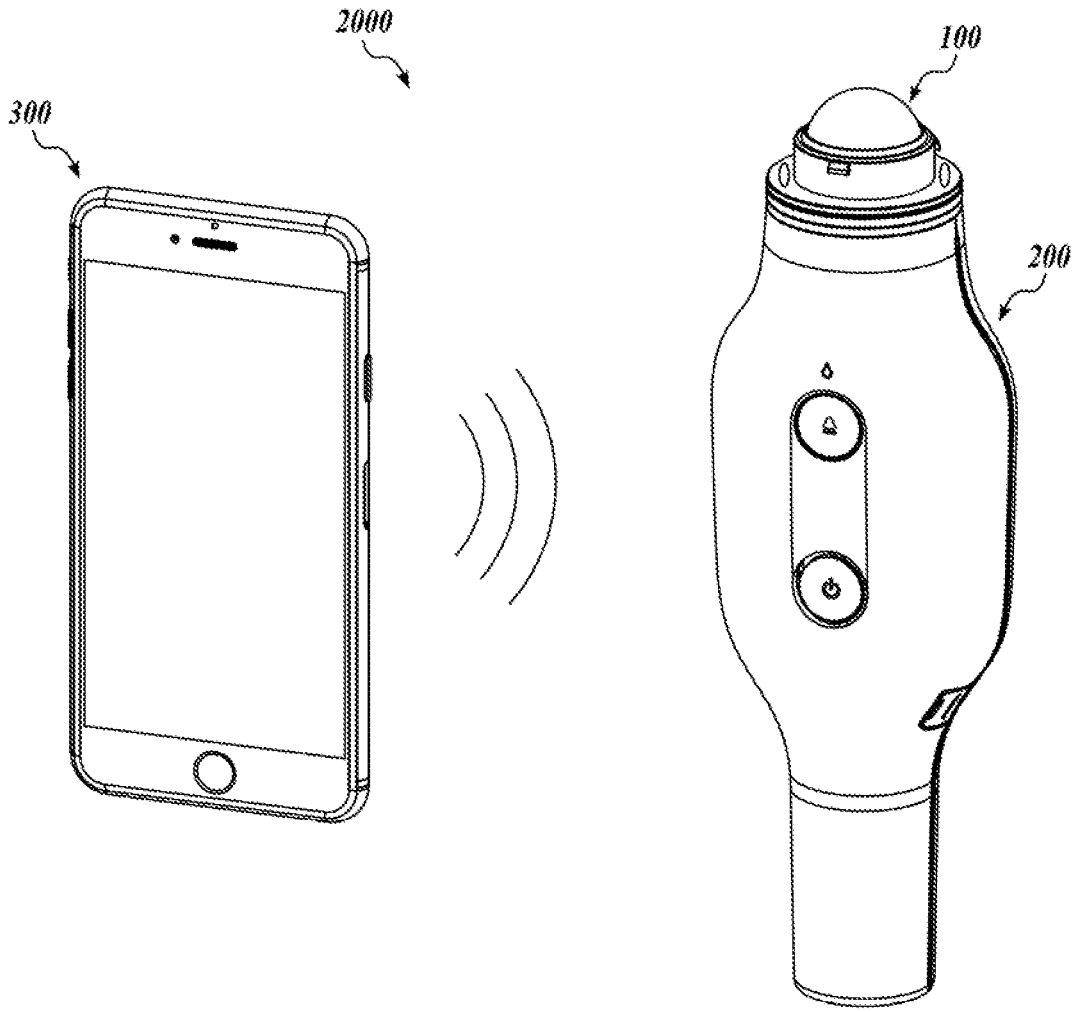
FIG. 5 is another example system, in accordance with the present technology.

FIG. 5 is another example system 2000, in accordance with the present technology. The system, which implements an applicator 100 and a base device 200 as described herein, further includes and a connected communication device 300. Optionally, the system may further include one or more external servers which are implemented as part of a cloud-computing environment.

The communication device 300 may be a personal computer (PC), a laptop computer, a PDA (Personal Digital Assistants), a smart phone, a tablet device, a UMPC (Ultra Mobile Personal Computer), a netbook, or a notebook type personal computer. In the below examples, the connected device 300 is assumed to be a smartphone, such as an Apple iPhone.

The communication device 300 is capable of performing wireless communication with the base device 300 by way of a wireless communication interface circuitry on the base device 200 or the applicator 100. However, communication device 300 is also capable of having a wired connection to the base device 200 by way of a USB interface. Additionally, the applicator 100 and the base device 200 may communicate with each other and the communication device 300 through an internet connection via an 802.11 wireless connection to a wireless internet access point, or a physical connection to the internet access point, such as through an Ethernet interface. Each connected communication device 300 is capable of performing wireless communication with other devices, such as through a Bluetooth connection or other wireless means as well.

The connected communication device 300 is configured to receive information from a user for use in generating a treatment plan, including one or more treatments, that may be used by the base device 200 to dispense one or more formulas, one or more light treatments, one or more radiation treatments, or a combination thereof.

In some embodiments, the communication device 300 has a related application on it, configured to aid a user in dispensing a formula and/or cleaning an applicator 100. In some embodiments, the application is configured to apply an algorithm to a photo or video of a user to detect one or more conditions. In some embodiments, the conditions may include a dark circle, acne, pigmentation, rosacea, wrinkles, fine lines, or wounds. Additionally, in some embodiments, the application is configured to diagnose one or more skin conditions using an AI algorithm. In some embodiments, the communication device 300 receives the condition data measured by the one or more sensor modules 135. In some embodiments, the AI algorithm confirms or adjusts the condition data with an AI. In some embodiments, the AI algorithm has been trained using a supervised learning model. In some embodiments, the AI algorithm is configured to classify the condition data in order to determine one or more conditions of the skin. In some embodiments, the communication device 300 communicates the detected condition to a user of the system and proposes one or more treatments to be applied by the applicator 100.

In some embodiments, the communication device 300 may further sense one or more environmental conditions with one or more communication device sensors. In some embodiments, the environmental conditions may include temperature, humidity, ultraviolet (UV), pollution, and the like. In some embodiments, the application can gather environmental data from other sources such as weather services. In some embodiments, the application can further recommend a formula, comprised of one or more skin ingredients, to the user based on the detected skin feature and/or environmental conditions.

In some embodiments, the user can set up a user profile on the application of the communication device 300. In some embodiments, setting up the user profile includes answering a user questionnaire. In some embodiments, the user questionnaire gives the user a series of inputs including past skin treatment, past use of the applicator, desired skin quality, or skin concern. In some embodiments, the application can solicit feedback from the user regarding their favorite or most effective formulation to help improve the algorithm.

Figure 6:
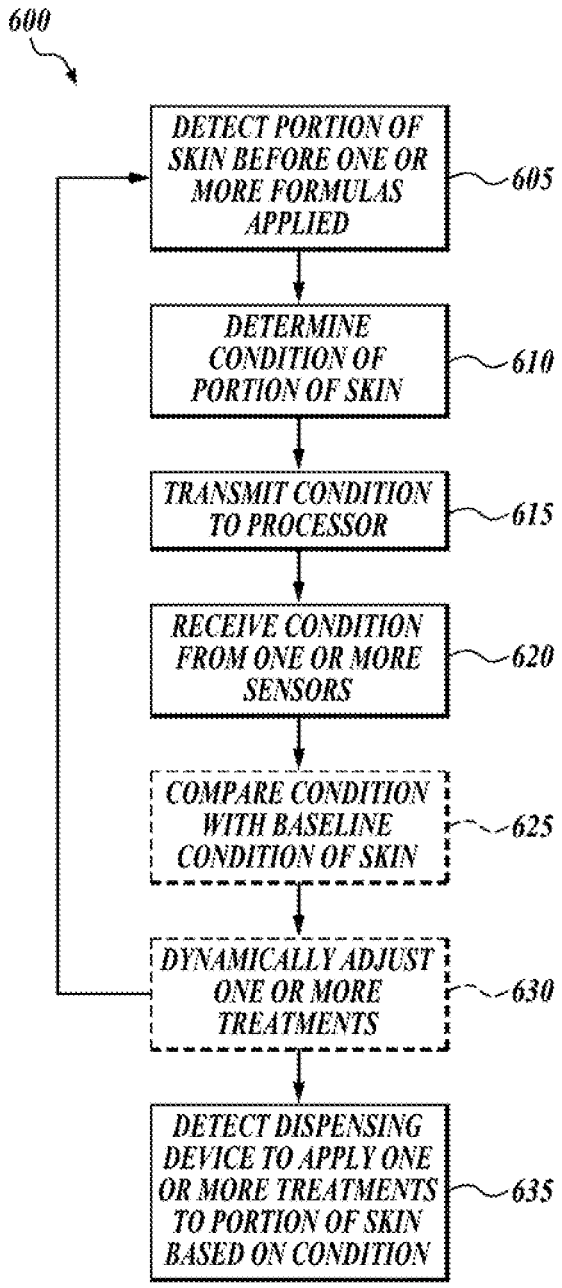
FIG. 6 is an example method of using a system, in accordance with the present technology.

FIG. 6 is an example method 600 of using a system, in accordance with the present technology. In some embodiments, the system is system 100 or system 2000 as shown and described in FIGS. 4-5. In some embodiments, the system includes an applicator (such as applicator 100 in FIGS. 1A-5) one or more sensor modules (such as sensor module 135 in FIGS. 1B-1C, 2B-2C, 3A-3B, and 4), and a processor (such as applicator processor 140, 240 or base device processor 255 as described herein). In some embodiments, the system includes one or more light sources (such as light sources 220 described herein) or one or more radiating elements (such as radiating elements 135 as described herein). In some embodiments, the system further includes a communication device (such as communication device 300) and/or a base device (such as base device 200).

In block 605, a portion of the skin is detected by an applicator or a base device. In some embodiments, this is achieved with one or more sensor modules as described herein. For example, one of the one or more sensor modules may include a position sensor, such as a camera, gyroscope, or accelerometer.

In block 610, a condition of the portion of skin is detected. In some embodiments, the one or more sensor modules 135 are configured to measure an impedance, a capacitance, a deflection, a color, a texture, a hydration level, or a combination thereof of the skin (collectively referred to herein as "measurements"). In some embodiments, these measurements may allow the sensor and or a processor (such as on the applicator, on the base device, or on the communication device) to determine a condition of the portion of the skin. In some embodiments, the condition is hyperpigmentation, acne, dark spots, fine lines, wrinkles, sun damage, dryness, lack of hydration, oiliness, or a combination thereof.

In block 615, the condition (or in some embodiments, the measurements) are transmitted to a processor. As described herein, the processor may be located on the applicator, the base device, the communication device, or a combination thereof. In some embodiments, the one or more sensor modules are communicatively coupled to the processor, such as through a wired or wireless connection. In some embodiments, the one or more sensor modules send only the measurements to the processor, which then determines the condition of the portion of skin based on the measurements. In some embodiments, the processor may include an artificial intelligence (AI) or machine learning (ML) algorithm configured to determine the condition.

In block 620, the processor (or processors) receive the condition and/or the measurements. In some embodiments, the processor determines the condition. In some embodiments, the processor confirms the condition. In some embodiments, the processor includes additional measurements, such as environmental parameters as described herein in determining or confirming the condition.

Optionally, in block 625, the condition detected by the one or more sensor modules and/or processed by the one or more processors is compared with a baseline condition of the skin. In some embodiments, the baseline condition is a past condition of the user's skin. In some embodiments, the baseline condition is based on an average or desired skin condition. In some embodiments, the baseline condition is stored and/or communicated to the user with the base device or the communication device. In some embodiments, the communication device stores each time the user applies one or more treatments, creating a user history of updated baseline conditions.

Optionally, in block 630, the applicator or the base device dynamically adjusts the one or more treatments. In some embodiments, the applicator of the base device adjusts the one or more treatments periodically as the user moves the applicator across the skin. In some embodiments, the base device adjusts the one or more treatments after a predetermined interval. In some embodiments, the predetermined interval is a predetermined distance across the skin. In some embodiments, the one or more portions of the skin are each of equal size, and as the user moves the applicator across each portion of the skin of the one or more portions the base device and/or the applicator adjusts the one or more treatments for each portion of skin of the one or more portions.

In block 635, a processor (such as the processor of the applicator, base device, and/or communication device) directs the applicator or the base device to apply the one or more treatments. In some embodiments, the one or more treatments are based on the detected condition. In some embodiments, the one or more treatments are based on the baseline condition. In some embodiments, the one or more treatments are adjusted in real time as the one or more sensor modules continue to take the measurements of the skin.

Figure 7:
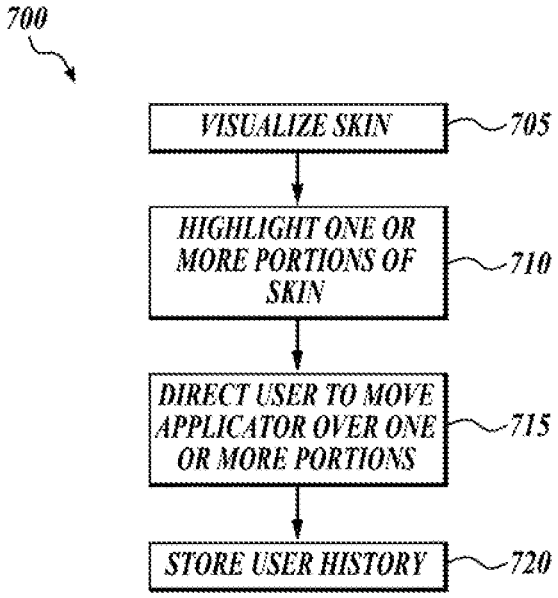
FIG. 7 is an example method of using a system, in accordance with the present technology.

FIG. 7 is an example method 700 of using a system, in accordance with the present technology. In some embodiments, the method 700 is carried out by a communication device (such as communication device 300). In some embodiments, the method 700 is carried out by a base device (such as the base device 200). In some embodiments, the method 700 may be a part of the method 600.

In block 705, the skin is visualized. In some embodiments, the skin is visualized by providing a graphic or a live feed on the communication device. In some embodiments, the one or more sensor modules include a camera, configured to take one or more images (i.e., photos, videos, or live feeds) of the skin as the user moves the applicator over the skin.

In block 710, one or more portions of the skin are highlighted. In some embodiments, the one or more portions are highlighted on the communication device, either graphically, or overlaid on an image taken with the one or more sensor modules. In some embodiments, the one or more portions are areas where formula has already been applied, one or more portions of skin where a condition has been detected, one or more portions where formula has not been applied, or a combination thereof. In some embodiments, the one or more portions are areas of interest, and different colors, symbols, patterns, or the like may be used to distinguish the areas of interest. For example, one or more portions of the skin including a condition may be demarcated with blue patches, one or more portions of skin where formula has been applied may be demarcated with red patches, and one or more portions of the skin where formula has not been applied may be demarcated with yellow patches. One skilled in the art will appreciate that the areas of interest may be highlighted in any manner.

In block 715, the communication device or base device may direct the user to move the applicator over the one or more portions. In some embodiments, as the applicator moves over the skin the one or more treatments can change to adapt to each of the areas of interest.

In block 720, the communication device or the base device stores a user history. As described herein, the user history may include a history of the one or more treatments, the location where one or more treatments have been applied, the location where one or more treatments have not been applied, a condition of one or more portions of the skin, and the like. It should be understood that methods 600 and 700 should be interpreted as merely representative. In some embodiments, process blocks of methods 600 and 700 may be performed simultaneously, sequentially, in a different order, or even omitted, without departing from the scope of this disclosure.

While illustrative embodiments have been illustrated and described, it will be appreciated that various changes can be made therein without departing from the spirit and scope of the invention.

The present application may reference quantities and numbers. Unless specifically stated, such quantities and numbers are not to be considered restrictive, but representative of the possible quantities or numbers associated with the present application. Also, in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 5% of the stated value. For the purposes of the present disclosure, the phrase "at least one of A, B, and C," for example, means (A), (B), (C), (A and B), (A and C), (B and C), or (A, B, and C), including all further possible permutations when greater than three elements are listed.

Embodiments disclosed herein may utilize circuitry in order to implement technologies and methodologies described herein, operatively connect two or more components, generate information, determine operation conditions, control an appliance, device, or method, and/or the like. Circuitry of any type can be used. In an embodiment, circuitry includes, among other things, one or more computing devices such as a processor (e.g., a microprocessor), a central processing unit (CPU), a digital signal processor (DSP), an application-specific integrated circuit (ASIC), a field-programmable gate array (FPGA), or the like, or any combinations thereof, and can include discrete digital or analog circuit elements or electronics, or combinations thereof.

An embodiment includes one or more data stores that, for example, store instructions or data. Non-limiting examples of one or more data stores include volatile memory (e.g., Random Access memory (RAM), Dynamic Random Access memory (DRAM), or the like), non-volatile memory (e.g., Read-Only memory (ROM), Electrically Erasable Programmable Read-Only memory (EEPROM), Compact Disc Read-Only memory (CD-ROM), or the like), persistent memory, or the like. Further non-limiting examples of one or more data stores include Erasable Programmable Read-Only memory (EPROM), flash memory, or the like. The one or more data stores can be connected to, for example, one or more computing devices by one or more instructions, data, or power buses.

In an embodiment, circuitry includes a computer-readable media drive or memory slot configured to accept signal-bearing medium (e.g., computer-readable memory media, computer-readable recording media, or the like). In an embodiment, a program for causing a system to execute any of the disclosed methods can be stored on, for example, a computer-readable recording medium (CRMM), a signal-bearing medium, or the like. Non-limiting examples of signal-bearing media include a recordable type medium such as any form of flash memory, magnetic tape, floppy disk, a hard disk drive, a Compact Disc (CD), a Digital Video Disk (DVD), Blu-Ray Disc, a digital tape, a computer memory, or the like, as well as transmission type medium such as a digital and/or an analog communication medium (e.g., a fiber optic cable, a waveguide, a wired communications link, a wireless communication link (e.g., transmitter, receiver, transceiver, transmission logic, reception logic, etc.). Further non-limiting examples of signal-bearing media include, but are not limited to, DVD-ROM, DVD-RAM, DVD+RW, DVD-RW, DVD-R, DVD+R, CD-ROM, Super Audio CD, CD-R, CD+R, CD+RW, CD-RW, Video Compact Discs, Super Video Discs, flash memory, magnetic tape, magneto-optic disk, MINIDISC, non-volatile memory card, EEPROM, optical disk, optical storage, RAM, ROM, system memory, web server, or the like.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result. Generally, the embodiments disclosed herein are non-limiting, and the inventors contemplate that other embodiments within the scope of this disclosure may include structures and functionalities from more than one specific embodiment shown in the figures and described in the specification.

In the foregoing description, specific details are set forth to provide a thorough understanding of exemplary embodiments of the present disclosure. It will be apparent to one skilled in the art, however, that the embodiments disclosed herein may be practiced without embodying all the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "vertical," "horizontal," "front," "rear," "left," "right," "top," and "bottom," etc. These references, and other similar references in the present application, are intended to assist in helping describe and understand the particular embodiment (such as when the embodiment is positioned for use) and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also, in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value. The term "based upon" means "based at least partially upon."

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A system for applying a formula, the system comprising:

an applicator, comprising:

a body;

one or more reservoirs inside the body, wherein the one or more reservoirs are configured to hold one or more formulas;

an applicator surface coupled to the body, wherein the applicator surface is configured to apply the one or more formulas;

one or more sensor modules, comprising:

one or more condition sensors located on the applicator, the one or more condition sensors configured to detect a condition of a portion of skin, before one or more formulas is applied to the portion of skin;

a position sensor configured to map the skin as the applicator surface moves across the skin;

a camera configured to take one or more images of the skin as a user moves the applicator over the skin;

a base device, comprising:

a base device processor configured to:

receive the condition from the one or more sensors; and direct the applicator to apply one or more treatments onto the portion of skin based on the condition; and a communication device, communicatively coupled to the base device, wherein the communication device is configured to:

display the one or more images of the skin;

highlight one or more portions of the skin in the one or more images of the skin;

propose one or more treatments to be applied to the one or more portions of the skin; and store a user history, wherein the user history includes information relating to a history of the one or more treatments, a location where one or more treatments have been applied, a location where one or more treatments have not been applied, or a condition of one or more portions of the skin.

2. The system of claim 1, wherein the base device processor is further configured to:

compare the condition with a baseline condition of the skin; and adjust the one or more treatments based on a deviation between the condition and the baseline condition.

3. The system of claim 1, wherein the portion of skin is a first portion of skin of a plurality of portions of skin, and wherein the base device processor is further configured to:

detect a condition of each portion of skin of the plurality of portions of skin; and adjust the one or more treatments for each portion of skin of the plurality of portions of skin independently.

4. The system of claim 3, wherein the one or more sensors are arranged in a ring on the applicator.

5. The system of claim 3, wherein an intensity, a frequency, a wavelength, or a combination thereof of the one or more light treatments is determined based on the condition of the skin.

6. The system of claim 3, wherein the one or more treatments comprise application of the one or more formulations, the one or more light treatments, or a combination thereof.

7. The system of claim 6, wherein the treatment comprises application of the one or more formulations, the one or more radiation treatments, or a combination thereof.

8. The system of claim 6, wherein the frequency, the amplitude, the power, or a combination thereof of the one or more radiation treatments is determined based on the condition of the skin.

9. The system of claim 1, wherein the applicator further comprises:

one or more light sources, wherein the one or more light sources are configured to apply one or more light treatments.

10. The system of claim 9, wherein the one or more light sources and the one or more sensors are alternately arranged in the ring.

11. The system of claim 1, wherein the applicator further comprises:

one or more radiating elements, wherein the one or more radiating elements are configured to emit one or more radiation treatments, each having a frequency, an amplitude, and a power.

12. The system of claim 1, wherein a flow rate, an amount, a temperature, a composition, or a combination thereof of the one or more formulas is determined based on the condition of the skin.

13. The system of claim 1, wherein the one or more sensors are configured to measure an impedance, a capacitance, a deflection, a color, a texture, a hydration level, or a combination thereof of the skin.

14. The system of claim 1, wherein the condition is hyperpigmentation, acne, dark spots, fine lines, wrinkles, sun damage, dryness, lack of hydration, oiliness, or a combination thereof.

15. The system of claim 1, wherein the applicator surface comprises one or more nozzles, wherein the one or more nozzles are in fluid communication with the one or more reservoirs.

16. The system of claim 15, wherein each nozzle of the one or more nozzles is configured to dispense a different formula of the one or more formulas.

17. The system of claim 15, wherein the amount of each formula of the one or more formulas dispensed is determined based on the condition.

18. The system of claim 1, wherein the applicator surface is a roller ball, wherein the roller ball is in fluid communication with the one or more reservoirs and the roller ball is configured to apply the one or more formulas as the roller ball rolls.

19. The system of claim 1, wherein the one or more areas of the skin are identified based at least in part on the user history; and wherein highlighting the one or more areas of the skin includes applying one or more overlays to the one or more images of the skin displayed on the communication device.

20. The system of claim 19, wherein the communication device displays the one or more images as a live feed.

* * * * *